US011724509B2

(12) United States Patent
Sato et al.

(10) Patent No.: US 11,724,509 B2
(45) Date of Patent: Aug. 15, 2023

(54) LIQUID SUPPLY MEMBER AND LIQUID DISCHARGE HEAD

(71) Applicant: CANON KABUSHIKI KAISHA, Tokyo (JP)

(72) Inventors: Ryo Sato, Tokyo (JP); Hiroki Tajima, Kanagawa (JP); Kyosuke Toda, Kanagawa (JP); Shimpei Yoshikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 17/373,596

(22) Filed: Jul. 12, 2021

(65) Prior Publication Data

US 2022/0016896 A1 Jan. 20, 2022

(30) Foreign Application Priority Data

Jul. 14, 2020 (JP) ..... 2020-120864

(51) Int. Cl.
*B41J 2/175* (2006.01)

(52) U.S. Cl.
CPC ..... *B41J 2/17553* (2013.01)

(58) Field of Classification Search
CPC ..... B41J 2/17553; B41J 2/17556; B41J 2/17513; B41J 2/01; B41J 2/175; B41J 2/17503
USPC ..... 347/94
See application file for complete search history.

(56) References Cited

U.S. PATENT DOCUMENTS

| | | | | |
|---|---|---|---|---|
| 5,153,612 | A | 10/1992 | Dunn et al. | |
| 6,863,390 | B2 | 3/2005 | Arai et al. | |
| 2003/0038868 | A1* | 2/2003 | Arai | B41J 2/14 347/94 |
| 2006/0038862 | A1* | 2/2006 | Tanno | B41J 2/17596 347/85 |

(Continued)

FOREIGN PATENT DOCUMENTS

| | | | |
|---|---|---|---|
| CN | 1401484 | A | 3/2003 |
| CN | 2875808 | Y | 3/2007 |
| CN | 101402286 | A | 4/2009 |

(Continued)

*Primary Examiner* — Matthew Luu
*Assistant Examiner* — Alexander D Shenderov
(74) *Attorney, Agent, or Firm* — Canon U.S.A., Inc. I.P. Division

(57) ABSTRACT

A liquid supply member includes a first member, a second member, and a damper member disposed between the first member and the second member, wherein the first member is a member configured to form a liquid chamber, wherein the damper member is a flexible member configured to form the liquid chamber together with the first member, wherein the second member is a member configured to form an atmosphere communication chamber communicating with an ambient atmosphere at a position between the damper member and the second member and opposing the liquid chamber with the damper member in between, and wherein a protrusion portion is formed on a surface of the second member facing the atmosphere communication chamber at a position corresponding to a central part of the damper member, the protrusion portion protruding toward the damper member beyond a connection surface between the damper member and the second member.

14 Claims, 10 Drawing Sheets

(56) References Cited

U.S. PATENT DOCUMENTS

| | | | |
|---|---|---|---|
| 2007/0052771 | A1 | 3/2007 | Inoue et al. |
| 2015/0375505 | A1 | 12/2015 | Takahashi |

FOREIGN PATENT DOCUMENTS

| | | | |
|---|---|---|---|
| CN | 101446326 | A | 6/2009 |
| CN | 101549583 | A | 10/2009 |
| CN | 105882147 | A | 8/2016 |
| CN | 106364159 | A | 2/2017 |
| CN | 108025551 | A | 5/2018 |
| CN | 108215501 | A | 6/2018 |
| EP | 1285761 | A1 | 2/2003 |
| EP | 3332973 | A1 | 6/2018 |
| EP | 3842241 | A1 | 6/2021 |
| JP | 2005047242 | A | 2/2005 |
| JP | 2006240150 | A | 9/2006 |
| JP | 2017039301 | A | 2/2017 |
| JP | 2017136822 | A | 8/2017 |

* cited by examiner

LIQUID SUPPLY MEMBER AND LIQUID DISCHARGE HEAD

BACKGROUND OF THE INVENTION

Field of the Invention

The present invention relates to a liquid supply member and a liquid discharge head.

Description of the Related Art

A liquid discharge apparatus such as an ink jet printer includes a liquid discharge head that discharges a liquid such as ink. When the liquid discharge head discharges a liquid from a high percentage of total discharge ports, such as from all discharge ports, a position of meniscus oscillates in each of the discharge ports. If the next discharge operation is performed in a state where the meniscus is at a protruded or retracted position due to such meniscus oscillation, small droplets are scattered in the former state, whereas a discharge speed or a discharge amount is reduced in the latter state. Thus, in either case, there is a possibility that liquid discharge accuracy may decrease.

Japanese Patent Application Laid-Open No. 2006-240150 discusses a liquid discharge head in which a flexible damper part is provided in a portion of a liquid chamber to suppress meniscus vibration in a discharge port. According to Japanese Patent Application Laid-Open No. 2006-240150, an area of the damper part on a side opposite to the liquid chamber communicates with an atmosphere to improve an effect of suppressing the meniscus oscillation.

SUMMARY OF THE INVENTION

As described above, if the area of the damper part on the side opposite to the liquid chamber communicates with the ambient atmosphere to improve the effect of suppressing the meniscus oscillation, the pressure in the area is held constant at the ambient atmospheric pressure even if the damper part is deformed. Thus, an amount of displacement of the damper part is large as compared to a case where the area does not communicate with the ambient atmosphere. Thus, for example, if the inside of the liquid chamber is pressurized for some reason such as cleaning of the liquid discharge head, the damper part is greatly displaced in a direction opposite to the liquid chamber, so that air or liquid may leak from a connecting portion between the damper part and a flow path member connected to the damper part.

According to an aspect of the present invention, a liquid supply member includes a first member, a second member, and a damper member disposed between the first member and the second member, wherein the first member is a member configured to form a liquid chamber for storing a liquid to be supplied to a discharge port for discharging the liquid, wherein the damper member is a flexible member configured to form the liquid chamber together with the first member, wherein the second member is a member configured to form an atmosphere communication chamber communicating with an ambient atmosphere at a position between the damper member and the second member and opposing the liquid chamber with the damper member in between, and wherein a protrusion portion is formed on a surface of the second member facing the atmosphere communication chamber at a position corresponding to a central part of the damper member, the protrusion portion protruding toward the damper member beyond a connection surface between the damper member and the second member.

Further features of the present invention will become apparent from the following description of exemplary embodiments with reference to the attached drawings.

DESCRIPTION OF THE EMBODIMENTS

Hereinafter, exemplary embodiments of the present disclosure will be described in detail.

(Liquid Discharge Head)

Figure 1B:
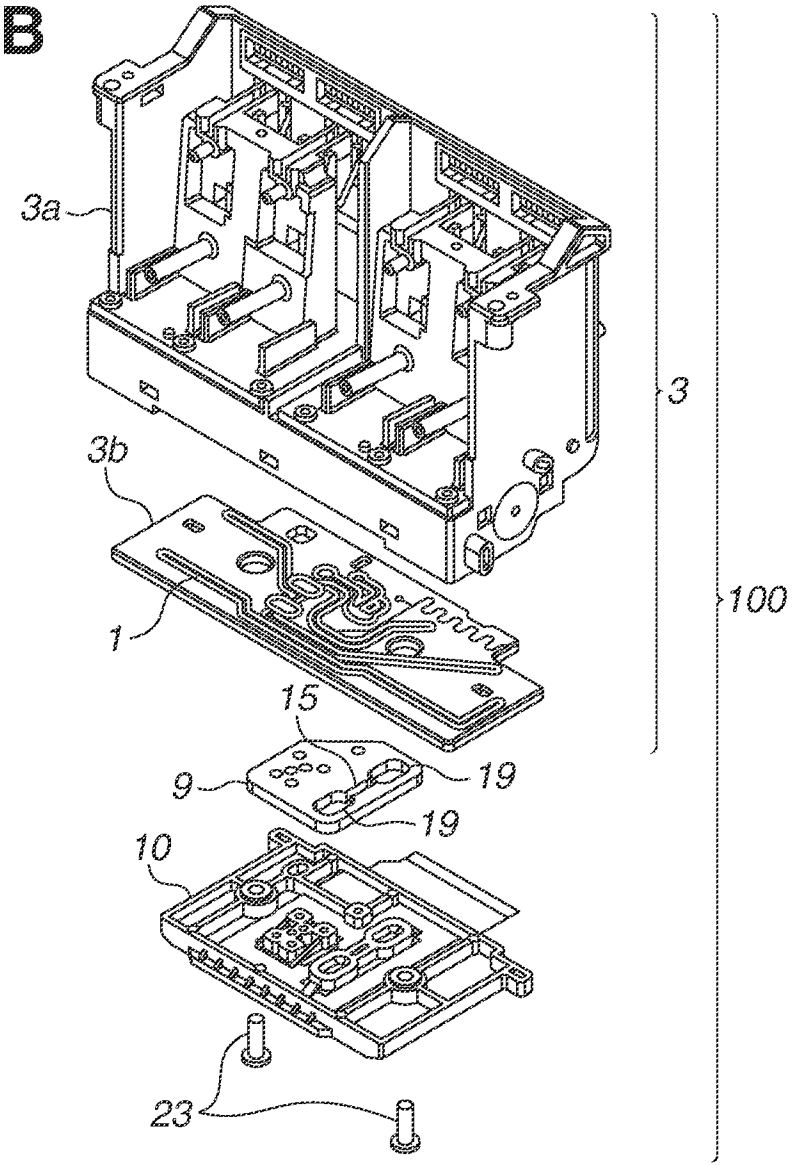
FIGS. 1A and 1B are perspective views illustrating a liquid discharge head.
Figure 1A:
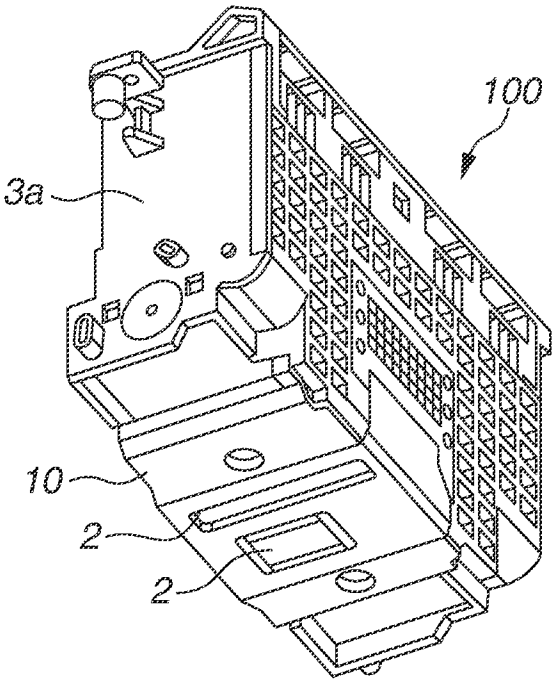

A liquid discharge head will be described with reference to FIGS. 1A, 1B, 2, and 10. FIG. 1A is a perspective view illustrating a liquid discharge head 100. FIG. 1B is an exploded perspective view illustrating the liquid discharge head 100. The liquid discharge head 100 mainly includes a support member (first member) 10, an element substrate 2, a flow path member (second member) 3 including a housing 3*a* and a flow path plate 3*b*, and a joint member 9. The flow path member 3, the joint member 9, and the support member 10 are connected (coupled) together mainly with screws 23.

Figure 2:
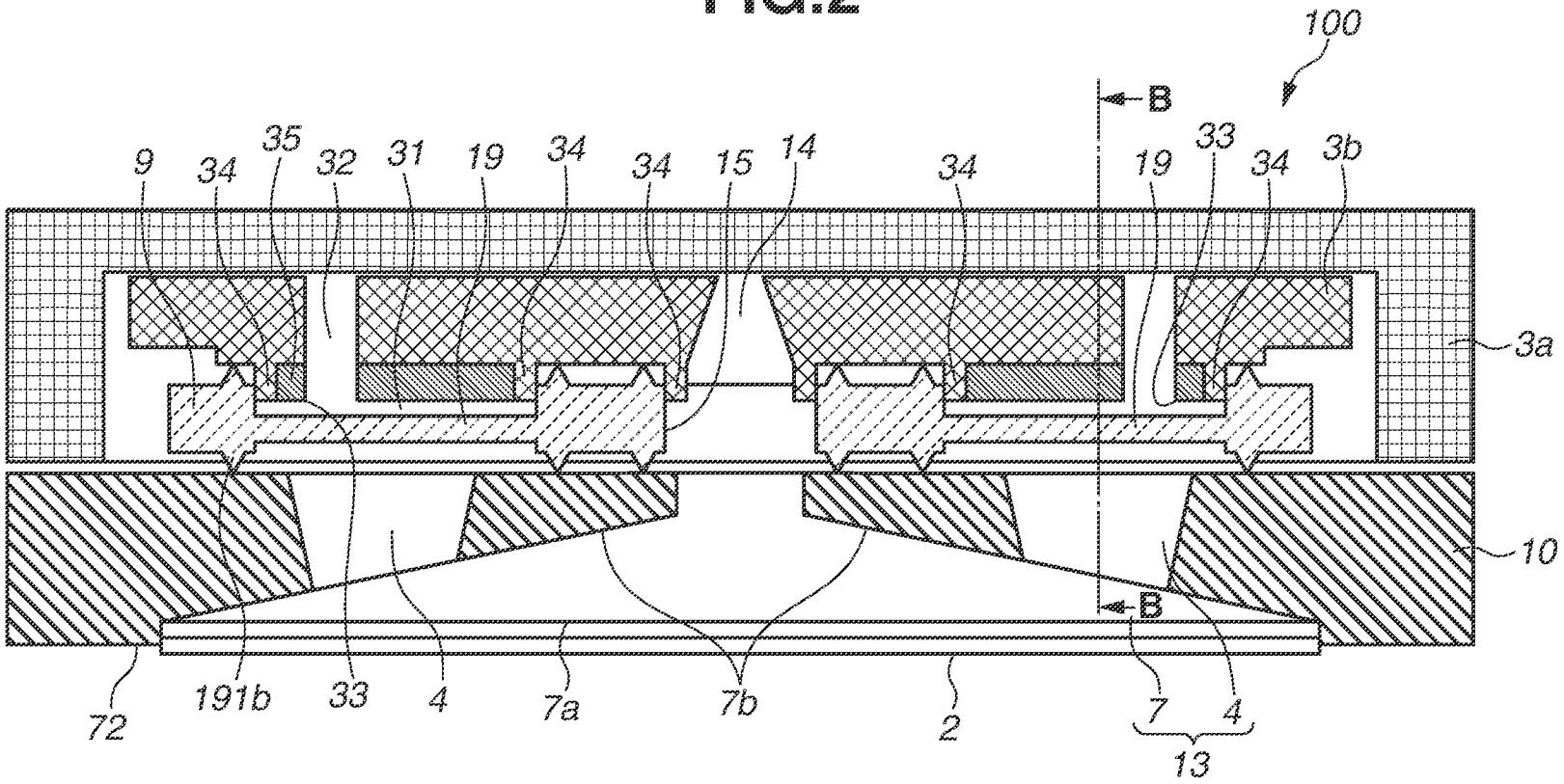
FIG. 2 is a cross-sectional view illustrating the liquid discharge head.
Figure 10:
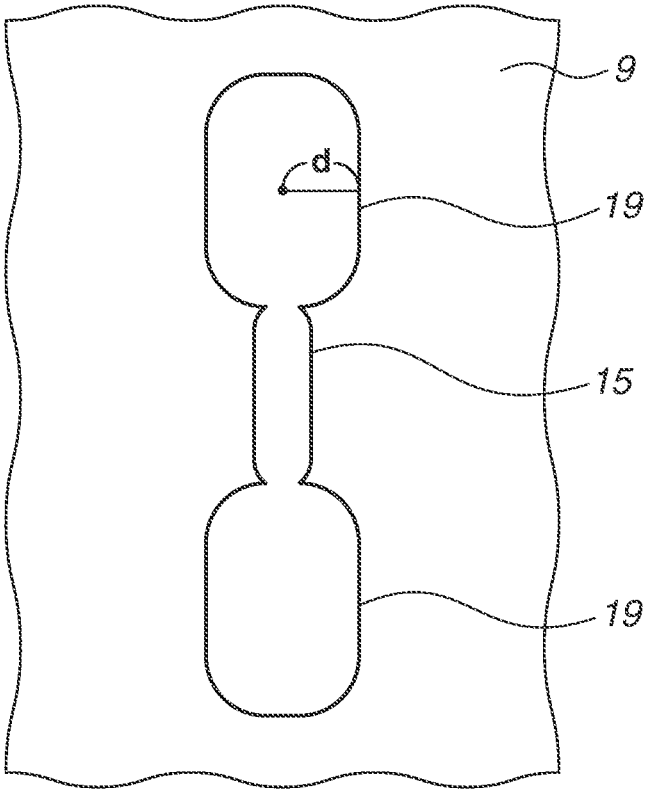
FIG. 10 is a schematic view illustrating a damper member.

The housing 3*a* is a member for attachment of an ink tank storing a liquid (ink). The flow path plate 3*b* has a flow path 1 for supplying the liquid from the ink tank to the element substrate 2. The joint member 9 is a member for connecting the flow path plate 3*b* and the support member 10 so that the liquid does not leak from a gap between the flow path plate 3*b* and the support member 10. The joint member 9 is formed of a flexible member such as a rubber member, and has damper members 19 for suppressing pressure fluctuation in a liquid chamber 13 (FIG. 2). The liquid chamber 13 includes an ink chamber 7 storing the ink, and buffer chambers 4 capable of holding air bubbles generated in the ink chamber 7. FIG. 10 schematically illustrates the top view of the joint member 9 around the damper members 19 illustrated in FIG. 1B. The damper members 19 each have a long side and a short side. One liquid discharge head 100 includes two damper members 19. The joint member 9 has an inlet 15, which communicates with a penetration port 14, between the two damper members 19 (FIG. 2). The support member 10 is a member for supporting the element substrate 2. The element substrate 2 includes a pressure generation element that generates pressure for discharging the liquid, and a discharge port from which the liquid is discharged.

FIG. 2 is a schematic cross-sectional view illustrating the liquid discharge head 100 illustrated in FIGS. 1A and 1B. The support member 10 has the liquid chamber 13 that stores the liquid to be supplied to the element substrate 2. The liquid passes through the penetration port 14 in the flow path plate 3*b* and is supplied to the liquid chamber 13 formed in the support member 10. Then, the liquid having been supplied to the liquid chamber 13 is supplied to the discharge port in the element substrate 2.

The liquid chamber 13 is shaped in such a manner that the distance between a surface 7*b* and a surface 7*a* of the liquid chamber 13 becomes shorter toward an end portion 72 of the surface 7*a* of the element substrate 2 on the liquid chamber side. Provided on the surface 7*b* are the buffer chambers 4, which are cavities formed by the damper members 19 of the joint member 9. Each of the damper members 19 is a flexible member formed of rubber, for example. Since the damper member 19 is formed to face the liquid chamber 13, even if the pressure in the liquid chamber 13 fluctuates, the damper member 19 is deformed to deal with the pressure fluctuation, thereby suppressing the pressure fluctuation in the liquid chamber 13.

Atmosphere communication chambers 31 are formed on a side of the damper members 19 opposite to the buffer chambers 4. Each of the atmosphere communication chambers 31 communicates with the ambient atmosphere (i.e. the atmosphere outside the liquid discharge head) via an atmosphere communication path 32 formed in the flow path plate 3*b*. Due to such communication with the atmosphere on the side of the damper members 19 opposite to the buffer chambers 4, the atmosphere communication chambers 31 maintain the atmospheric pressure irrespective of the amount of deformation of each of the damper members 19, which allows an increase in the amount of deformation of the damper member 19. This further suppresses the pressure fluctuation in the liquid chamber 13.

(Protrusion Portion)

Figure 3:
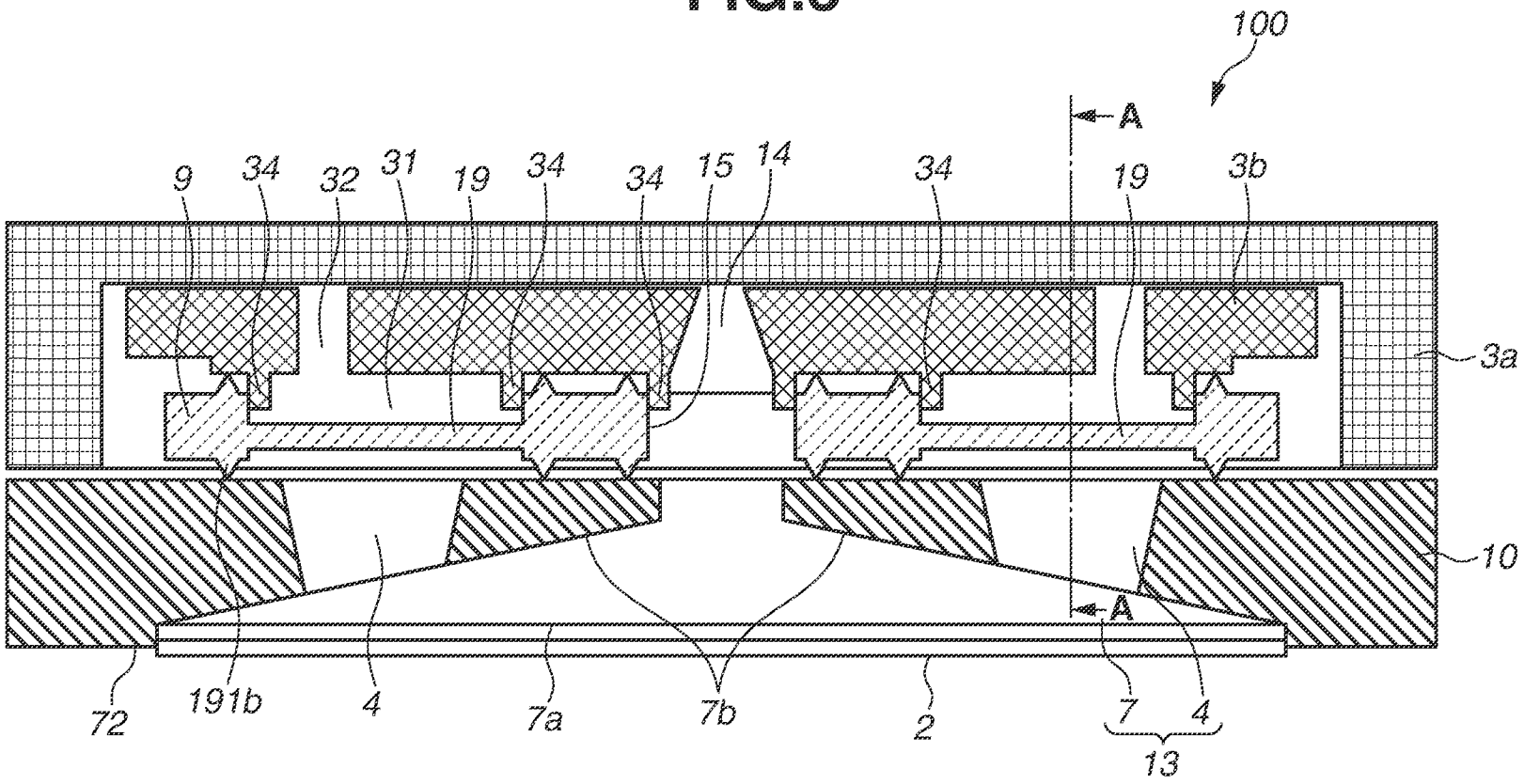
FIG. 3 is a cross-sectional view illustrating a liquid discharge head in a conventional example.
Figure 4:
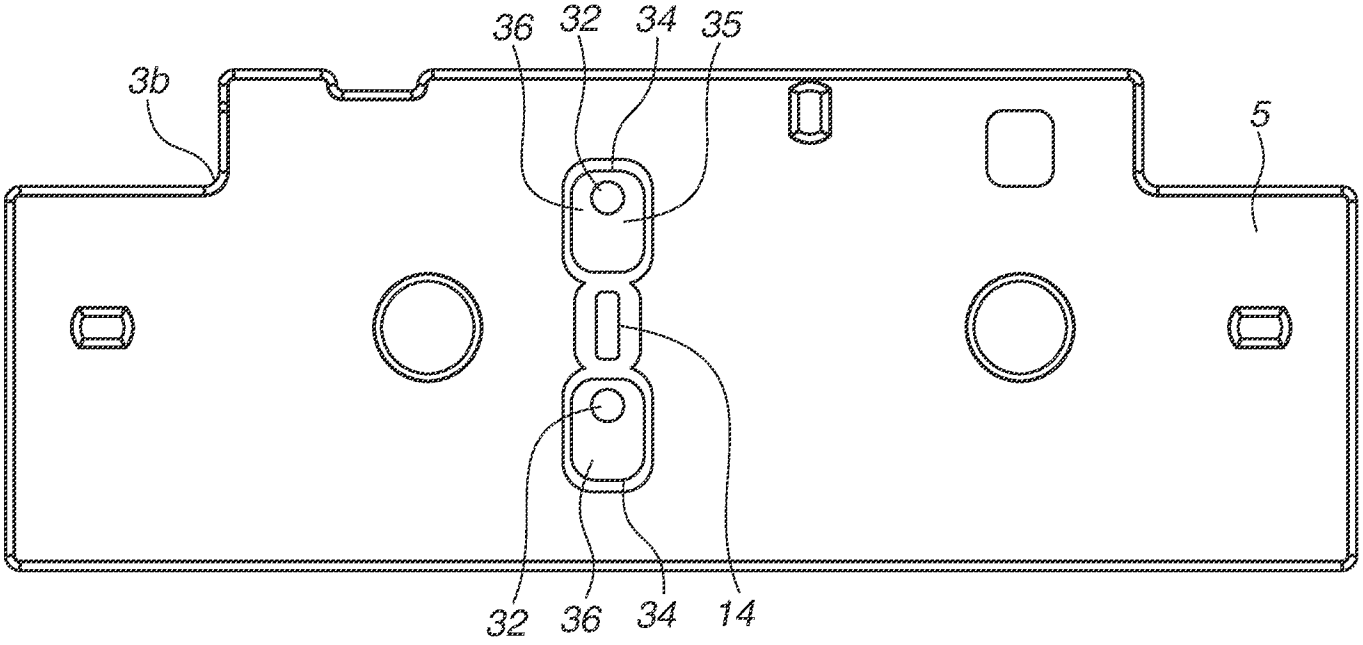
FIG. 4 is a schematic view illustrating a flow path plate in the conventional example.
Figure 5B:
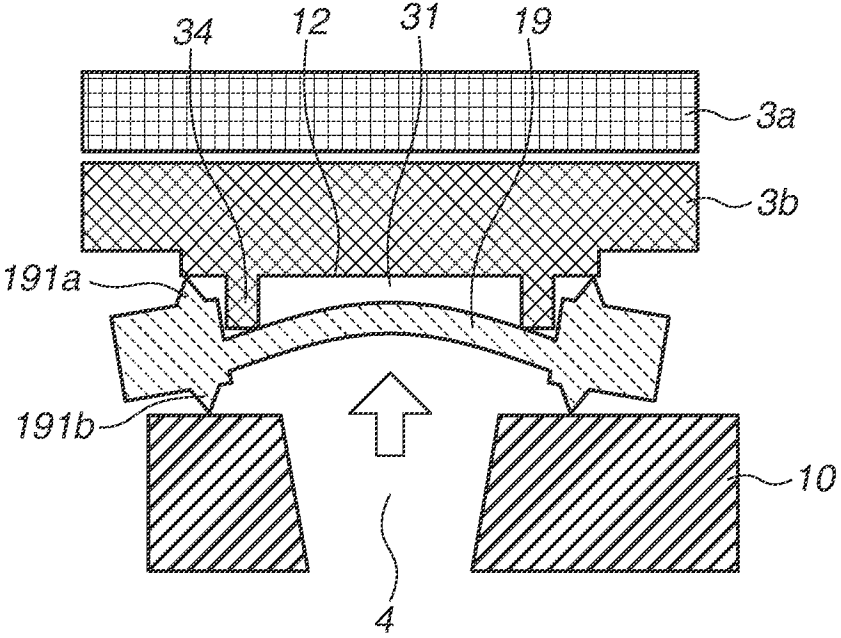
FIGS. 5A and 5B are schematic views illustrating a damper member in the conventional example.
Figure 5A:
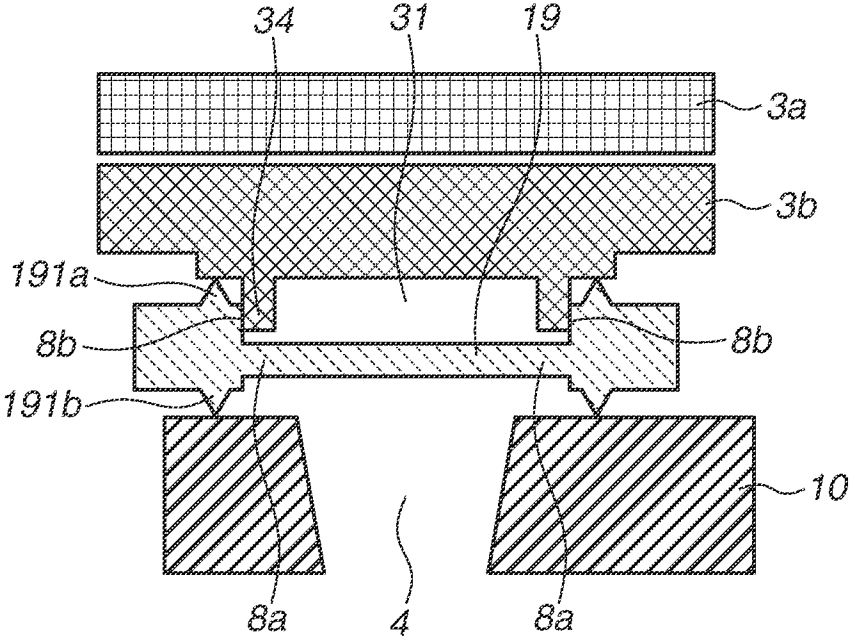
Figure 6:
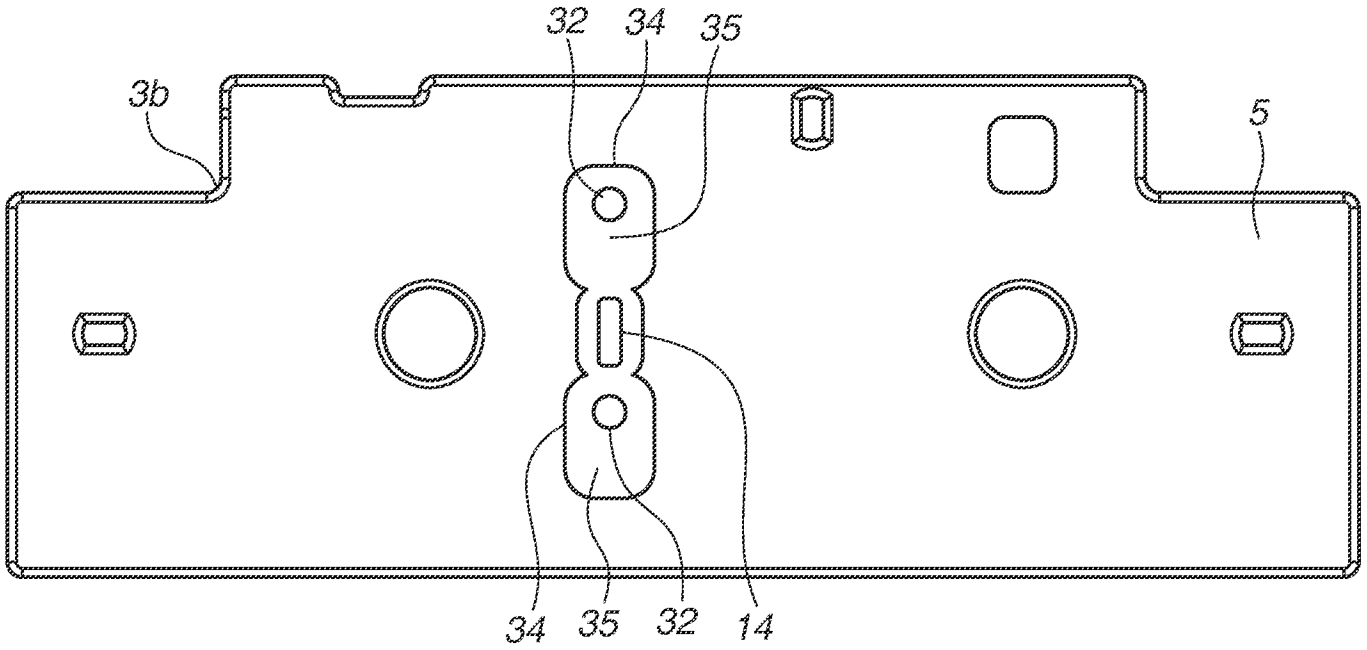
FIG. 6 is a schematic view illustrating a flow path plate according to a first exemplary embodiment.
Figure 7B:
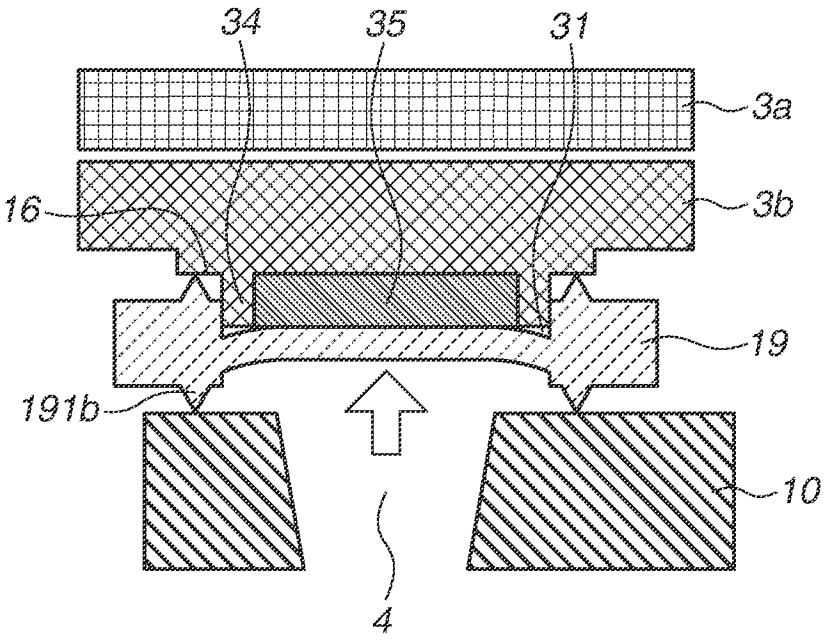
FIGS. 7A and 7B are schematic view illustrating a damper member.
Figure 7A:
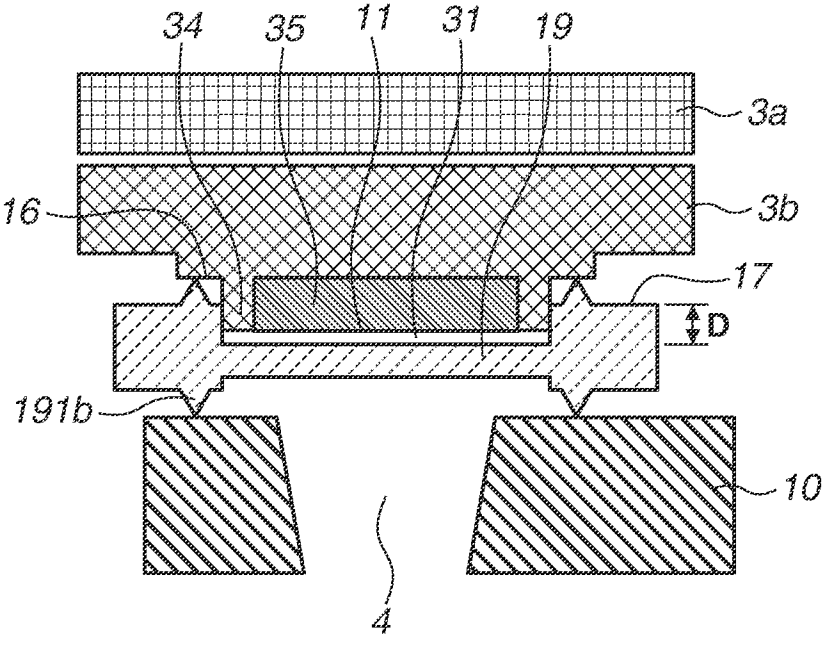

A protrusion portion will be described with reference to FIGS. 3 to 7A and 7B. FIG. 3 is a schematic cross-sectional view illustrating a conventional liquid discharge head, which corresponds to the cross-sectional view illustrating the liquid discharge head according to a first exemplary embodiment illustrated in FIG. 2. FIG. 4 is a schematic view illustrating a surface 5 of a conventional flow path plate 3*b* facing a joint member 9 illustrated in FIG. 3. FIG. 5A is a schematic cross-sectional view illustrating a conventional liquid discharge head taken along line A-A of FIG. 3. FIG. 5B is a diagram schematically illustrating the state of a damper member 19 in a case where the inside of a liquid chamber 13 is pressurized in the state illustrated in FIG. 5A. FIG. 6 is a schematic view illustrating the flow path plate 3*b* according to the present exemplary embodiment illustrated in FIG. 2, which corresponds to FIG. 4. FIG. 7A is a schematic cross-sectional view illustrating the liquid discharge head taken along line B-B of FIG. 2. FIG. 7B is a diagram schematically illustrating the state of the damper member 19 in a case where the inside of the liquid chamber 13 is pressurized in the state illustrated in FIG. 7A.

As illustrated in FIG. 4, outer edge members 34 are formed on the surface 5 of the conventional flow path plate 3*b* at positions opposing end portions 8*a* of damper members 19. The outer edge members 34 are provided to fix the flow path plate 3*b* and the damper members 19 at appropriate positions. FIG. 5B illustrates a state in which the liquid chamber 13 is pressurized. However, in contrast, if the liquid chamber 13 is in a pressure-reduced state, the damper member 19 is deformed toward the liquid chamber 13, and the end portions 8*a* of the damper member 19 are pulled toward a central part. At this time, if the end portions 8*a* of the damper member 19 are deformed excessively toward the central part, gaps may be about to occur between lip portions 191*a* at the end portions 8*a* of the damper member 19 and the flow path plate 3*b*. However, since an end surface 8*b* of the joint member 9 is in contact with the outer edge member 34, occurrence of a leak from the lip portions 191*a* of the damper member 19 can be suppressed. Each of the end portions 8*a* of the damper member 19 here refers to an area with a length of d/3 from the end surface 8*b* (outer edge) of the joint member 9, where d represents the shortest distance from the center of gravity of the damper member 19 to the outer edge of the damper member 19 (see FIG. 10). The damper member 19 refers to an area that is deformed depending on the pressure fluctuation in the liquid chamber 13. More specifically, in the state illustrated in FIG. 5A, the thin-plate portion between two end surfaces 8*b* constitutes the damper member 19.

On the other hand, as illustrated in FIG. 5B, when the inside of the liquid chamber 13 is pressurized, the damper member 19 is deformed toward the atmosphere communication chamber 31. Then, the end portions 8*a* of the damper member 19 are pulled toward the central part. At this time, if the amount of deformation of the damper member 19 toward the atmosphere communication chamber 31 exceeds a certain amount, lip portions 191*b* of the damper member 19, which are connecting parts between the damper member 19 and the support member 10, are lifted, and a leak of the liquid or air occurs.

Thus, a protrusion portion 35 is formed on the surface of the flow path member (second member) 3 facing the atmosphere communication chamber 31 at a position corresponding to the central part of the damper member 19. The protrusion portion 35 protrudes toward the damper member 19 beyond a connection surface 16 between the damper member 19 and the flow path member 3 (FIGS. 7A and 7B). The protrusion portion 35 is formed on the flow path member (second member) 3 at the position facing the central part of the damper member 19 because the amount of deformation of the damper member 19 is large at the central part. By forming the protrusion portion 35 at the position facing the central part of the damper member 19 where the amount of deformation is large, it is possible to suppress excessive deformation of the damper member 19 and suppress the occurrence of a leak from the lip portions 191*b*. Specifically, the protrusion portion 35 according to the present exemplary embodiment has a columnar shape as illustrated in FIGS. 2, 6, 7A, and 7B, and is formed across an entire area surrounded by the outer edge member 34, except for an opening 33 on the atmosphere communication chamber side (hereinafter, simply called opening 33) of the atmosphere communication path 32. The central part of the damper member 19 refers to an area encircled by a circle with a radius d/2 and centered on the center of gravity of the damper member 19, where d represents the shortest distance from the center of gravity of the damper member 19 to the outer edge of the damper member 19 (see FIG. 10). The formation of the protrusion portion 35 across the entire area surrounded by the outer edge member 34 except for the opening 33 of the atmosphere communication path 32 means that the protrusion portion 35 accounts for 90% or more of the volume of the area surrounded by the outer edge member 34.

The protrusion portion 35 is molded integrally with the flow path plate 3*b*. Alternatively, the flow path plate 3*b* and the protrusion portion 35 may be separate members, and the protrusion portion 35 may be incorporated into a hollow portion 36 of the outer edge member 34 by press-fitting or welding.

In order to suppress the occurrence of a leak when the liquid chamber 13 is pressurized, a distance between a surface 12 of the flow path plate 3*b* facing the damper member 19 and the damper member 19 may be shortened to suppress large deformation of the damper member 19 and to suppress the occurrence of a leak. However, for the flow path plate 3*b* and the damper members 19 to be fitted and connected to each other, it is necessary that the end portions 8*a* of the damper member 19 be thick to some degree and that the flow path plate 3*b* be provided with the outer edge member 34. Thus, there is a limit to the extent to which the distance between the surface 12 of the flow path plate 3*b* and the damper members 19 can be shortened. Thus, the above-described protrusion portion 35 is useful in suppressing the occurrence of a leak when the liquid chamber 13 is pressurized.

As illustrated in FIGS. 7A and 7B, the protrusion portion 35 is not in contact with the damper member 19. This is because, if the protrusion portion 35 is in contact with the damper member 19, deformation of the damper member 19 is suppressed at a contact part, and a function thereof as a damper may be deteriorated. If the protrusion portion 35 protrudes only slightly toward the damper member 19, the effect of suppressing the excessive deformation of the damper member 19 will be lessened. Thus, a leading end of the protrusion portion 35 is preferably at a distance greater than or equal to D/5 and less than or equal to 4D/5 from a surface 17 of the joint member 9 on the flow path member 3 side (second member side) where D represents the distance between the surface 17 and the damper member 19.

The present exemplary embodiment has been described with reference to the drawings illustrating the outer edge members 34. However, the outer edge members 34 may not be formed on the flow path plate 3*b* in the present exemplary embodiment. Even without the outer edge members 34, the formation of the protrusion portion 35 suppresses the excessive deformation of the damper members 19. This can suppress a leak of the air or liquid even in a state where the liquid chamber 13 is pressurized.

Figure 8A:
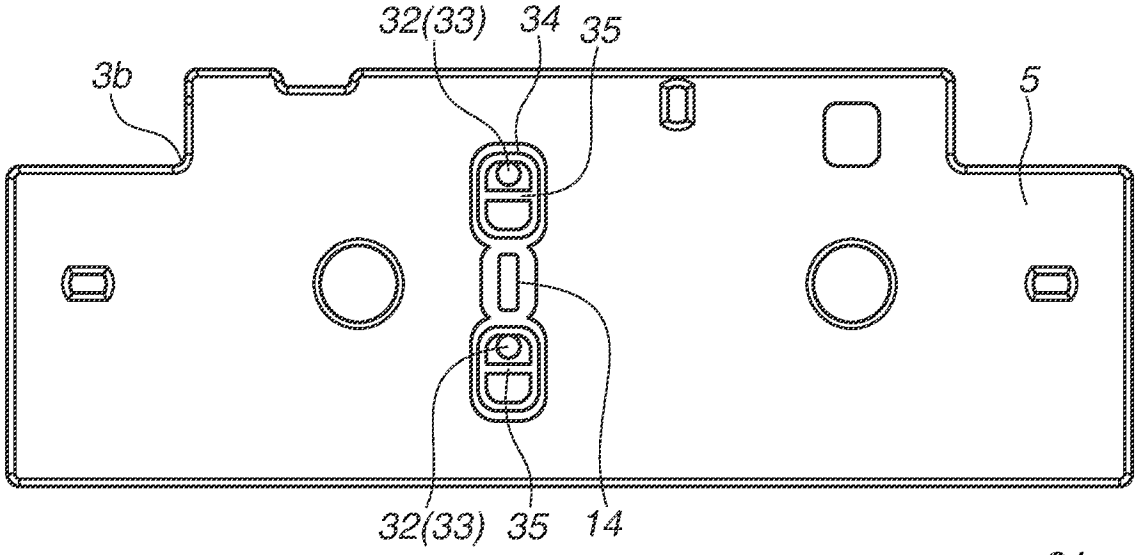
FIGS. 8A and 8B are schematic views illustrating a flow path plate according to a second exemplary embodiment.
Figure 8B:
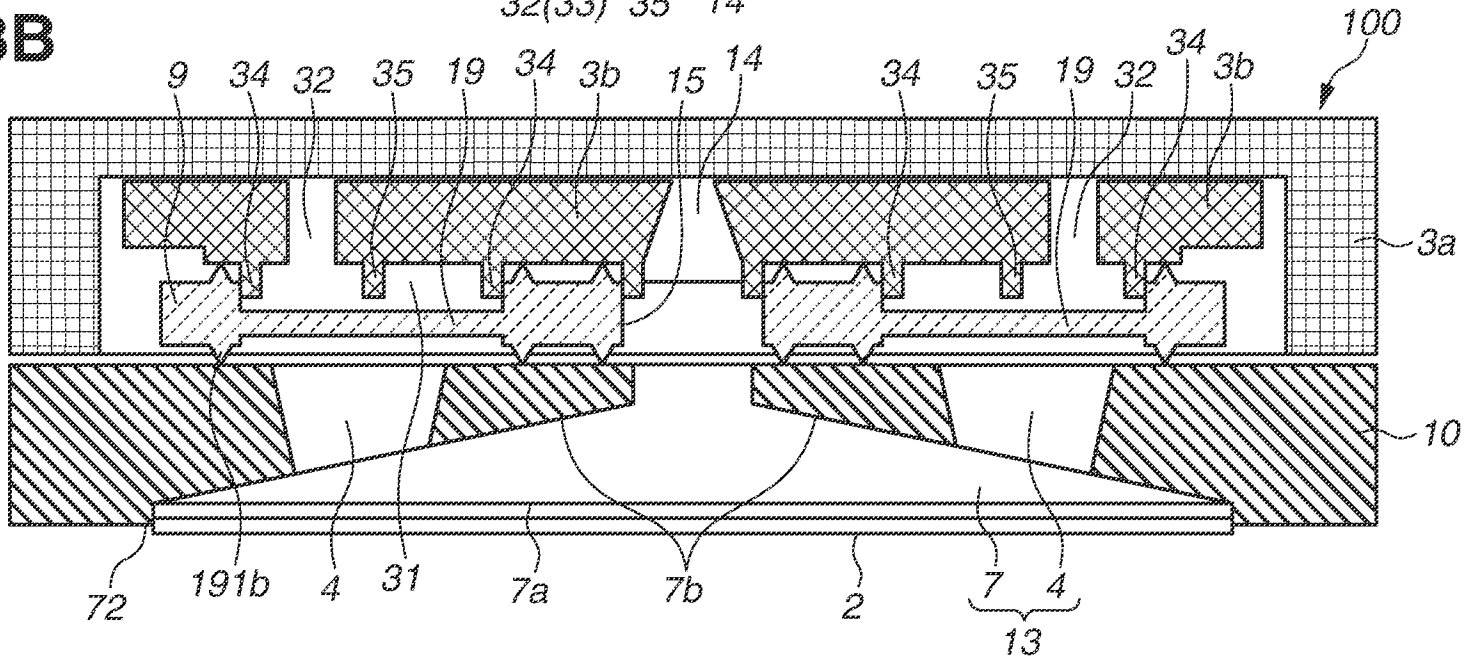
Figure 9:
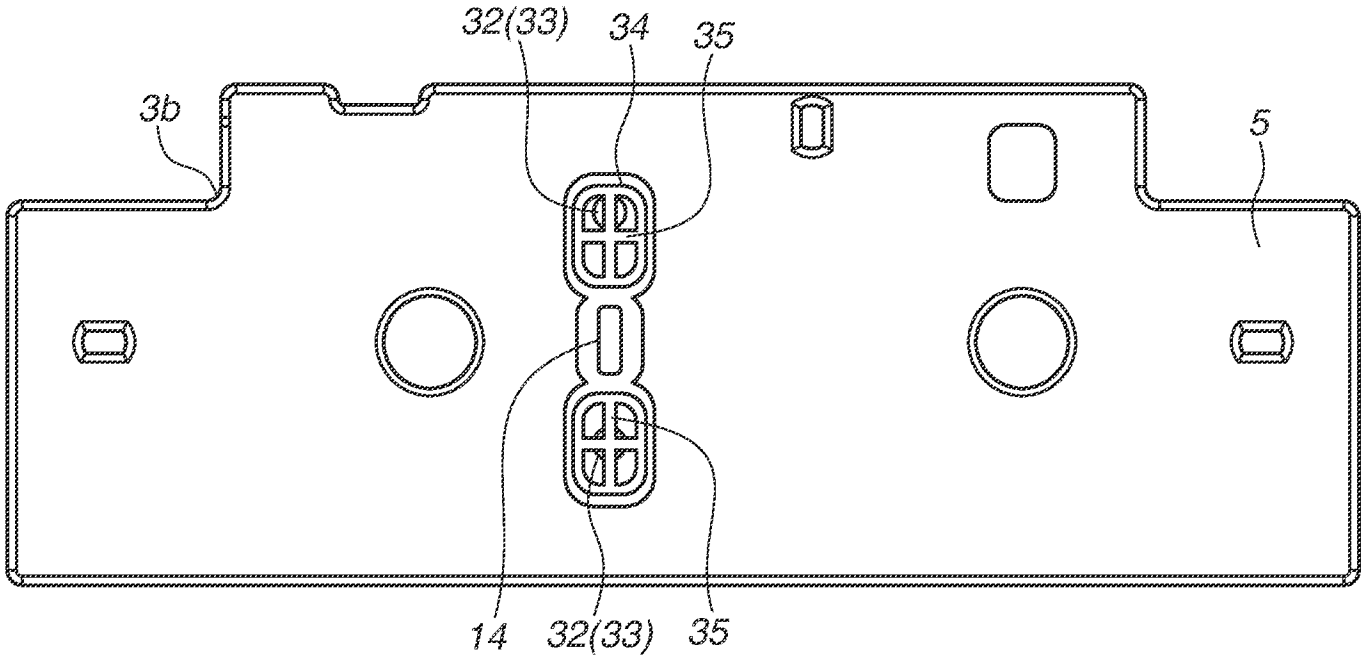
FIG. 9 is a schematic view illustrating a flow path plate according to the second exemplary embodiment.

A second exemplary embodiment will be described with reference to FIGS. 8A, 8B, and 9. Components in the second exemplary embodiment similar to those in the first exemplary embodiment are denoted with the same reference signs, and description thereof will be omitted. FIG. 8A is a schematic view illustrating protrusion portions 35 according to the present exemplary embodiment, which corresponds to FIG. 4. FIG. 8B is a diagram corresponding to FIG. 2, where the protrusion portions 35 illustrated in FIG. 8A are formed. FIG. 9 is a schematic view illustrating a modification example of the present exemplary embodiment. The present exemplary embodiment is characterized in that the shape of each of the protrusion portions 35 is different from that according to the first exemplary embodiment. The protrusion portions 35 formed on the flow path plate 3*b* illustrated in FIGS. 8A and 8B are each shaped to connect to two long sides of the outer edge member 34.

In the first exemplary embodiment, the protrusion portion 35 is formed across the entire area of the hollow portion 36 surrounded by the outer edge member 34 except for the atmosphere communication path 32. Thus, the opening 33 of the atmosphere communication path 32 constitutes an under surface 11 of the protrusion portion 35 (a surface of the protrusion portion 35 facing the damper member 19). In this case, if the damper member 19 is deformed toward the atmosphere communication chamber 31 as illustrated in FIG. 7B, the opening 33 of the atmosphere communication path 32 may be blocked by the deformed damper member 19. Thus, in the present exemplary embodiment, the position at which the protrusion portion 35 is provided is limited, and the opening 33 on the atmosphere communication path side is formed in a surface 5 of the flow path plate 3*b*. Accordingly, if the damper member 19 is deformed toward the atmosphere communication chamber 31, it is possible to suppress the opening 33 of the atmosphere communication path 32 from being blocked.

Specifically, referring to FIGS. 8A and 8B, the protrusion portion 35 is formed at a position opposing the central part of the damper member 19 where the damper member 19 is largely displaced, and not in the entire area of the hollow portion 36. The protrusion portion 35 is formed to divide the hollow portion 36 surrounded by the outer edge member 34 into two areas. The protrusion portion 35 according to the present exemplary embodiment is formed in a smaller area than that of the protrusion portion 35 illustrated in FIGS. 7A and 7B, which improves moldability of the flow path plate 3*b* even in a case where a complicated flow path is formed on the back side of the surface 5 of the flow path plate 3*b*.

In the present exemplary embodiment, the protrusion portion 35 may be shaped to link the four sides of the outer edge member 34 as illustrated in FIG. 9. In other words, the protrusion portion 35 may be formed to divide the hollow portion 36 into four areas. In this case, the opening 33 of the atmosphere communication path 32 is preferably formed over a plurality of areas of the hollow portion 36 divided into the four areas by the protrusion portion 35. Forming the opening 33 of the atmosphere communication path 32 over the plurality of areas further suppresses the opening 33 of the atmosphere communication path 32 from being blocked by the deformation of the damper member 19. The opening 33 of the atmosphere communication path 32 illustrated in the upper part of FIG. 9 is formed across two of the four divided areas of the hollow portion 36. The opening 33 of the atmosphere communication path 32 illustrated in the lower part of FIG. 9 is formed across the four divided areas of the hollow portion 36.

FIGS. 8A, 8B, and 9 illustrate examples where one opening 33 is formed at a position at which the opening 33 is across the plurality of areas divided by the protrusion portion 35, but the present exemplary embodiment is not limited to these examples. More specifically, for example, the opening 33 may not be formed across the plurality of areas but four openings 33 may be formed in four respective divided areas. This produces similar advantageous effects.

In the present exemplary embodiment illustrated in FIGS. 8A, 8B, and 9, the protrusion portion 35 is formed inside a circle with a radius of d/2 and centered on the center of gravity of the damper member 19 as an example. More preferably, however, the protrusion portion 35 is formed inside a circle with a radius of d/3 and centered on the center of gravity of the damper member 19. Further preferably, the protrusion portion 35 is formed inside a circle with a radius of d/4 and centered on the center of gravity of the damper member 19. The damper member 19 shaped as illustrated in each of the exemplary embodiments is deformed centered on the center of gravity thereof, and thus has the largest amount of deformation at the center of gravity. Therefore, the protrusion portion 35 is preferably formed inside the circle with the radius of d/3 or inside the circle with the radius of d/4 and centered on the center of gravity of the damper member 19, rather than the protrusion portion 35 being formed in the circle with the radius d/2 and centered on the center of gravity of the damper member 19.

The exemplary embodiments have been described taking the liquid discharge head 100 as an example. However, the present disclosure is not limited to this example. More specifically, the present disclosure is also suitably applicable to a liquid supply member for supplying a liquid to a discharge port (for example, an ink tank or a flow path member separate from an element substrate).

While the present invention has been described with reference to exemplary embodiments, it is to be understood that the invention is not limited to the disclosed exemplary embodiments.

This application claims the benefit of Japanese Patent Application No. 2020-120864, filed Jul. 14, 2020, which is hereby incorporated by reference herein in its entirety.

What is claimed is:

1. A liquid supply member comprising:

a first member configured to form a liquid chamber for storing a liquid to be supplied to a discharge port for discharging the liquid;

a damper member, formed of a flexible material, configured to form the liquid chamber together with the first member;

a second member configured to form an atmosphere communication chamber, communicating with an ambient atmosphere, at a position between the damper member and the second member and opposing the liquid chamber with the damper member in between; and a protrusion portion contiguous with the second member and extending from a surface of the second member facing the atmosphere communication chamber, the protrusion portion protruding toward the damper member beyond a connection surface between the damper member and the second member.

2. The liquid supply member according to claim 1, wherein the second member has an outer edge portion extending from the surface of the second member toward the damper member beyond the connection surface between the damper member and the second member at a position opposing an end portion of the damper member, wherein the atmosphere communication chamber communicates with the ambient atmosphere via an atmosphere communication path, and wherein the atmosphere communication path has an opening on an atmosphere communication chamber side in an area surrounded by the outer edge member.

3. The liquid supply member according to claim 2, wherein the protrusion portion is formed across the entire area surrounded by the outer edge member except for the atmosphere communication path.

4. The liquid supply member according to claim 2, wherein the protrusion portion is formed to divide the area surrounded by the outer edge member into a plurality of areas.

5. The liquid supply member according to claim 4, wherein the protrusion portion is formed to divide the area surrounded by the outer edge member into two areas.

6. The liquid supply member according to claim 4, wherein the protrusion portion is formed to divide the area surrounded by the outer edge member into four areas.

7. The liquid supply member according to claim 4, wherein the opening of the atmosphere communication path is formed in the plurality of areas surrounded by the outer edge member and divided by the protrusion portion.

8. The liquid supply member according to claim 7, wherein the opening of the atmosphere communication path is formed in two areas surrounded by the outer edge member and divided by the protrusion portion.

9. The liquid supply member according to claim 7, wherein the opening of the atmosphere communication path is formed in four areas surrounded by the outer edge member and divided by the protrusion portion.

10. The liquid supply member according to claim 1, wherein the first member is a support member configured to support an element substrate including the discharge port.

11. The liquid supply member according to claim 1, wherein the second member is a flow path member including a flow path for supplying the liquid to the liquid chamber.

12. The liquid supply member according to claim 1, wherein the damper member includes a rubber member.

13. The liquid supply member according to claim 1, further comprising a joint member including the damper member, wherein, where D represents a distance between a surface of the joint member on a second member side and the damper member, a leading end of the protrusion portion is at a distance greater than or equal to D/5 and less than or equal to 4D/5 from the surface.

14. A liquid discharge head comprising:

the liquid supply member according to claim 1; and an element substrate including a pressure generation element configured to generate pressure for discharging a liquid.

* * * * *